US007909205B2

(12) United States Patent
Moon

(10) Patent No.: US 7,909,205 B2
(45) Date of Patent: Mar. 22, 2011

(54) COSMETIC CONTAINER

(75) Inventor: Hyun-Myung Moon, Yongin (KR)

(73) Assignee: Interwork Korea Co., Ltd, Seoul (KR)

( * ) Notice: Subject to any disclaimer, the term of this patent is extended or adjusted under 35 U.S.C. 154(b) by 826 days.

(21) Appl. No.: 11/507,992

(22) Filed: Aug. 22, 2006

(65) Prior Publication Data

US 2007/0080094 A1 Apr. 12, 2007

(30) Foreign Application Priority Data

Oct. 11, 2005 (KR) ..... 20-2005-0028966
Mar. 23, 2006 (KR) ..... 20-2006-0007793

(51) Int. Cl.
*B65D 51/04* (2006.01)

(52) U.S. Cl. ..... 220/817; 132/293; 132/294; 132/295; 132/297; 132/301; 206/581

(58) Field of Classification Search ..... 132/293, 132/294, 295, 297, 301; 206/581; 220/817
See application file for complete search history.

(56) References Cited

U.S. PATENT DOCUMENTS 5,975,093 A * 11/1999 Joulia ..... 132/293

FOREIGN PATENT DOCUMENTS

KP 20-0367712 11/2004
KP 200367712 * 11/2004

* cited by examiner

*Primary Examiner* — Anthony Stashick
*Assistant Examiner* — Elizabeth Volz
(74) *Attorney, Agent, or Firm* — Gifford, Krass, Sprinkle, Anderson & Citkowski, P.C.

(57) ABSTRACT

The present invention relates to a cosmetic container having a rotatable cover including a mirror so that a user may look at the mirror from a desired direction. In a configuration of the cosmetic container, a body and the cover of the cosmetic container are connected by a shaft penetrating a pivot bearing and hinges formed on one side of the body or the cover, and the cover may be horizontally rotated with respect to the body by a pivot head integrally formed with the cover or the pivot bearing and divided in two.

1 Claim, 7 Drawing Sheets

COSMETIC CONTAINER

CROSS-REFERENCE TO RELATED APPLICATION

This application claims priority to and the benefit of Korea Utility Model No. 20-2005-0028966 filed on Oct. 11, 2005, and No.20-2006-0007793 filed on Mar. 23, 2006 in the Korean Intellectual Property Office, the entire contents of which are incorporated herein by reference.

BACKGROUND OF THE INVENTION (a) Field of the Invention

The present invention relates to a cosmetics container, and more particularly, to a cosmetics container for containing powders and foundation cream.

(b) Description of the Related Art

In general, a compact is used for containing cosmetics including powders and foundation cream. A conventional compact includes a mirror provided on the inside upper cover, the inside of the compact is divided into several parts, and a puff and more than two kinds of cosmetics are provided to the divided parts.

Accordingly, it is inconvenient to open the cover of the compact to use the mirror. In addition, since an opening direction of the cover is predetermined, it is inconveniently required to move the mirror when a person shows his face from another angle.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a cosmetic container including a cover performing a pivot rotation when opening the cover so that a user may look at a mirror attached to the cover from a predetermined angle and inconvenience in using the cosmetic container may be reduced.

In addition, the present invention has been made in an effort to provide a cosmetic container including a cover opened from the cosmetic container in a predetermined direction and rotated in a vertical direction to the predetermined opening/closing direction.

An exemplary cosmetic container according to an embodiment of the present invention includes a cover connected to one side of a body having an inner portion that is divided into a plurality of portions, so that the cover is opened from the body. The body includes a pair of hinges integrally formed at one side of the body, and a pivot bearing formed between the hinges and supported by a shaft so that the body is rotated in the opening/closing direction. The cover includes a pivot axis divided in two, integrally formed with the cover, and protruded from the cover. A head of the pivot axis is inserted to a pivot hole of the pivot bearing so that the cover is horizontally rotated with respect to the body.

An exemplary cosmetic container according to another embodiment of the present invention includes a cover connected to one side of a body having an inner portion that is divided into a plurality of portions, so that the cover is opened from the body. The body includes a pivot hole formed on one side of the body and a pivot bearing is inserted to the pivot hole so that the pivot bearing is rotated. The cover includes hinges disposed on both sides of the pivot bearing and supported by a shaft penetrating the hinges and the pivot bearing so that the cover is rotated in the opening/closing direction. With respect to the body, a rotation of the cover based on the pivot bearing is performed and a rotation of the cover based on the shaft is performed.

DESCRIPTION OF REFERENCE NUMERALS INDICATING PRIMARY ELEMENTS IN THE DRAWINGS

| | |
|---|---|
| 2: Inner storage portion | 4: Body |
| 6: Hinge | 7, 9: Shaft holes |
| 8: Pivot bearing | 10: Shaft |
| 12: Pivot hole | 14: Cover |
| 16: Pivot axis | 18: Mirror |
| 20: Pivot head | 22: Latch |
| 24: Locking groove | 26. 28: Magnets |

DETAILED DESCRIPTION OF THE EMBODIMENTS

Exemplary embodiments of the present invention will hereinafter be described in detail with reference to the accompanying drawings.

FIG. 1 to FIG. 4 show diagrams representing a cosmetic container according to a first exemplary embodiment of the present invention.

Figure 1:
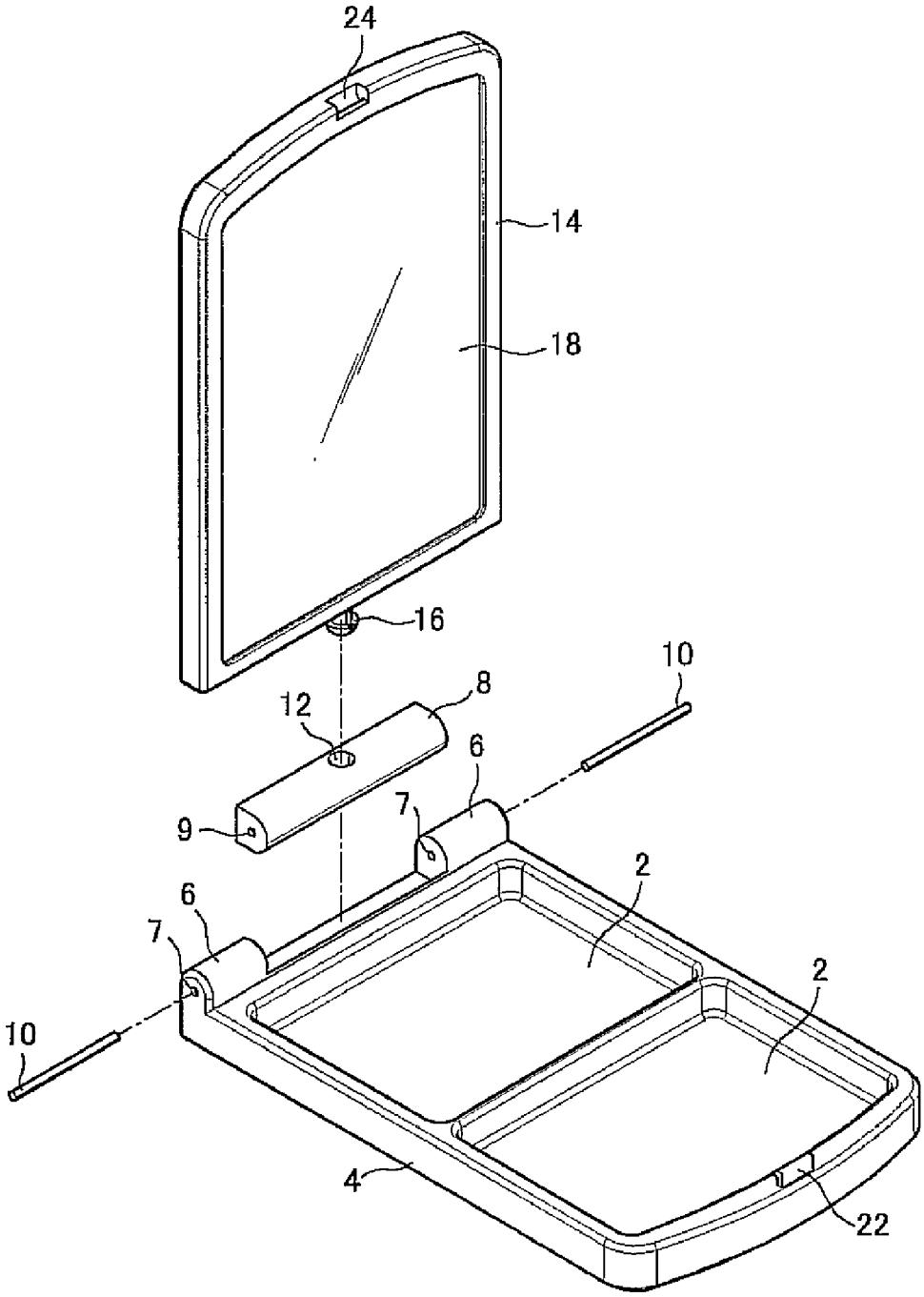
FIG. 1 shows an exploded perspective view of a cosmetic container according to an exemplary embodiment of the present invention.

As shown in FIG. 1, the cosmetic container includes a body 4, and the inside of the body 4 is divided into a plurality of inner storage portions 2.

The body 4 includes a pair of hinges 6 positioned at one side of the body 4, a pivot bearing 8 is provided between the hinges 6, and a shaft 10 penetrating a shaft hole 7 of the hinges 6 and a shaft hole 9 of the pivot bearing 8 is provided so that they are rotatably connected to each other.

A pivot hole 12 is provided in a center of the pivot bearing 8, and a pivot axis 16, which is integrally formed with a cover 14 and protruded from the cover 14, is inserted into the pivot hole 12.

Figure 2:
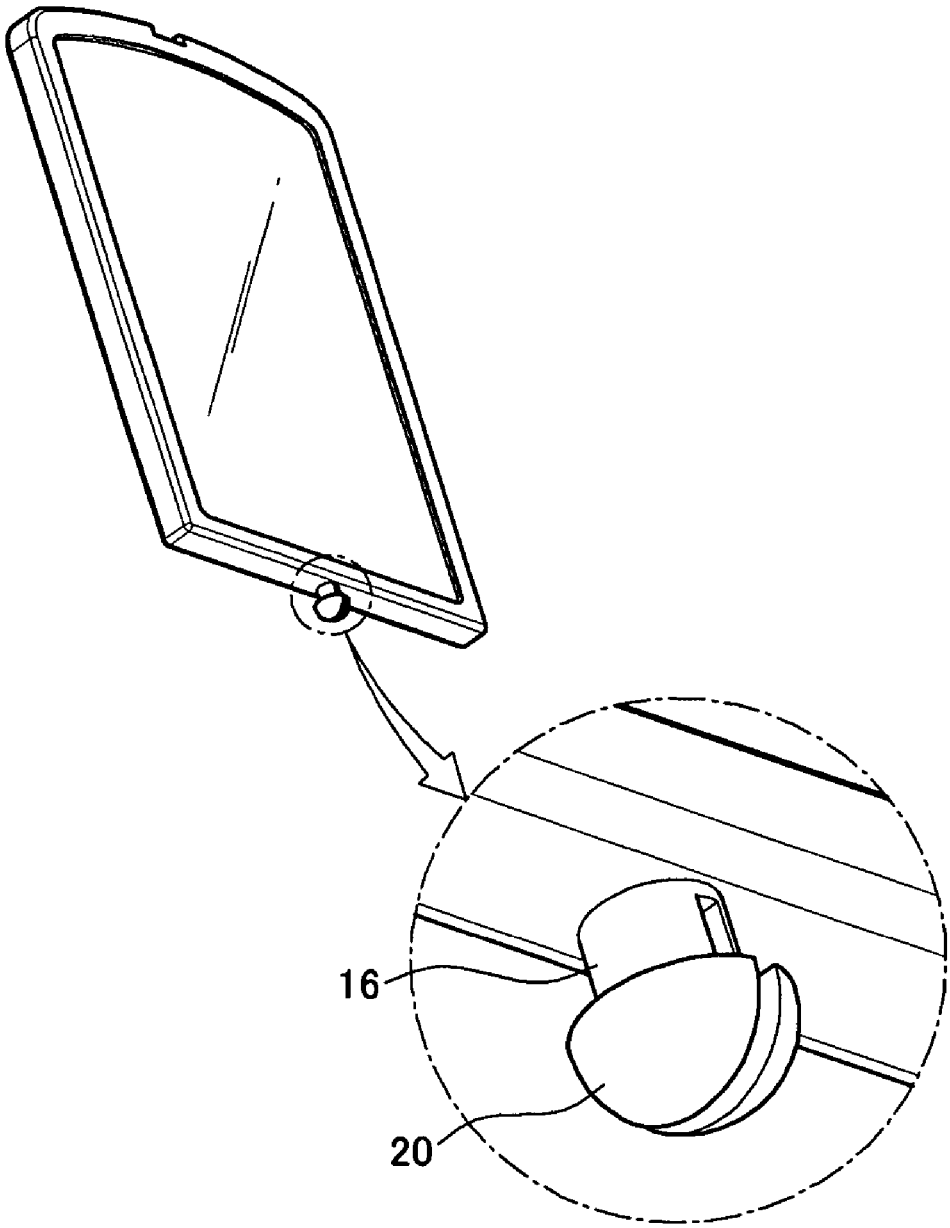
FIG. 2 shows a magnified perspective view of a pivot axis shown in FIG. 1.

As shown in FIG. 2, the pivot axis 16 includes a head 20 divided in two in a length direction so that a diameter of the head 20 is reduced when the head 20 is inserted to the pivot hole 12 of the pivot bearing 8. After being inserted to the pivot hole 12, the diameter of the head 20 becomes wide by its self-elasticity so that the head 20 is latched into the pivot hole 12.

The body 4 is connected to the cover 14 such that they can be relatively rotated based on the pivot bearing 8, and a latch 22 formed at one end of the body 4 is combined to a locking groove 24 formed at an end of the cover 14 that corresponds to the end of the body 4 when the body 4 and the cover 14 are folded.

Figure 3:
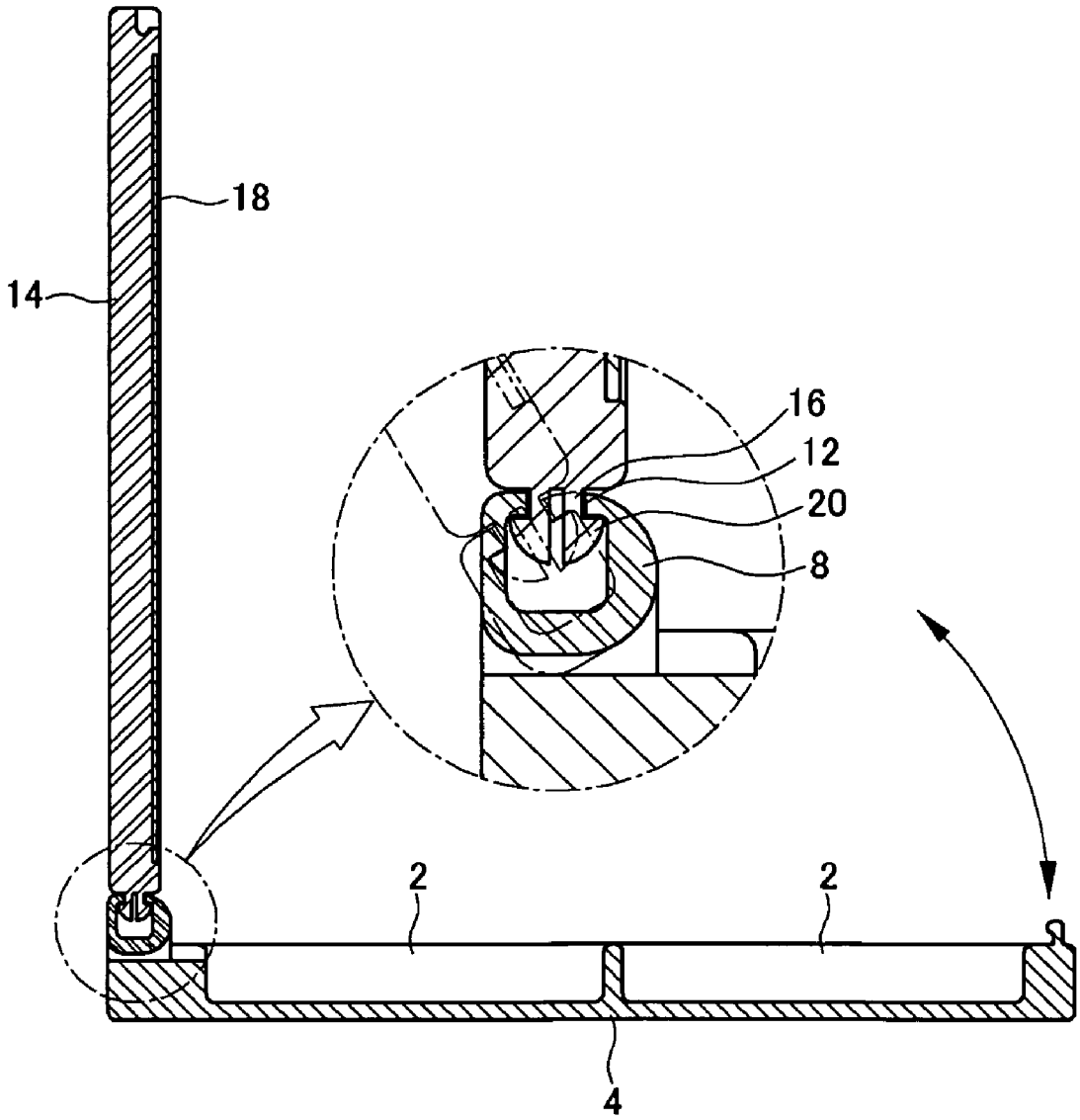
FIG. 3 shows a cross-sectional side view of an assembled cosmetic container.

According to the first exemplary embodiment of the present invention, an opening angle of the cover 14 is limited from a 130 degree angle to a 150 degree angle since the pivot bearing 8 is formed in a non-circular angle, as shown in FIG. 3 with an alternate long and short dash line.

Figure 4:
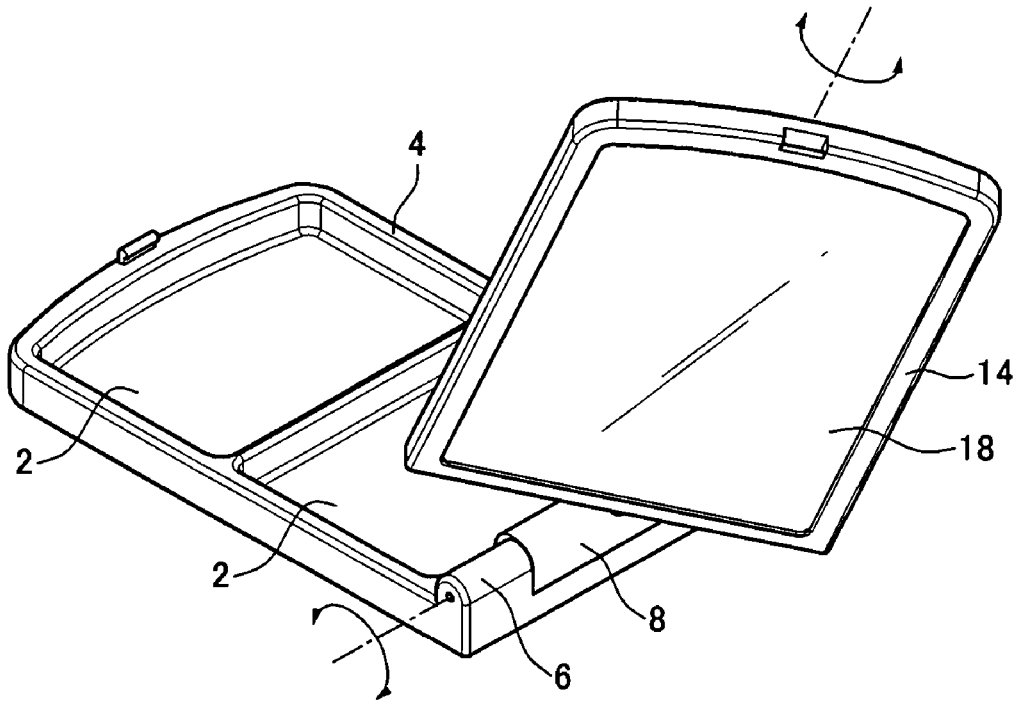
FIG. 4 shows a perspective view representing an example of a pivot rotation of a cover with respect to a body.

In addition, since the cover 14 is rotated based on the pivot bearing 8 while being opened and closed, and it performs a pivot rotation by the pivot axis 16 based on the pivot bearing 8, a position and a posture of the mirror provided on the inside of the cover 14 may vary as shown in FIG. 4.

Figure 5:
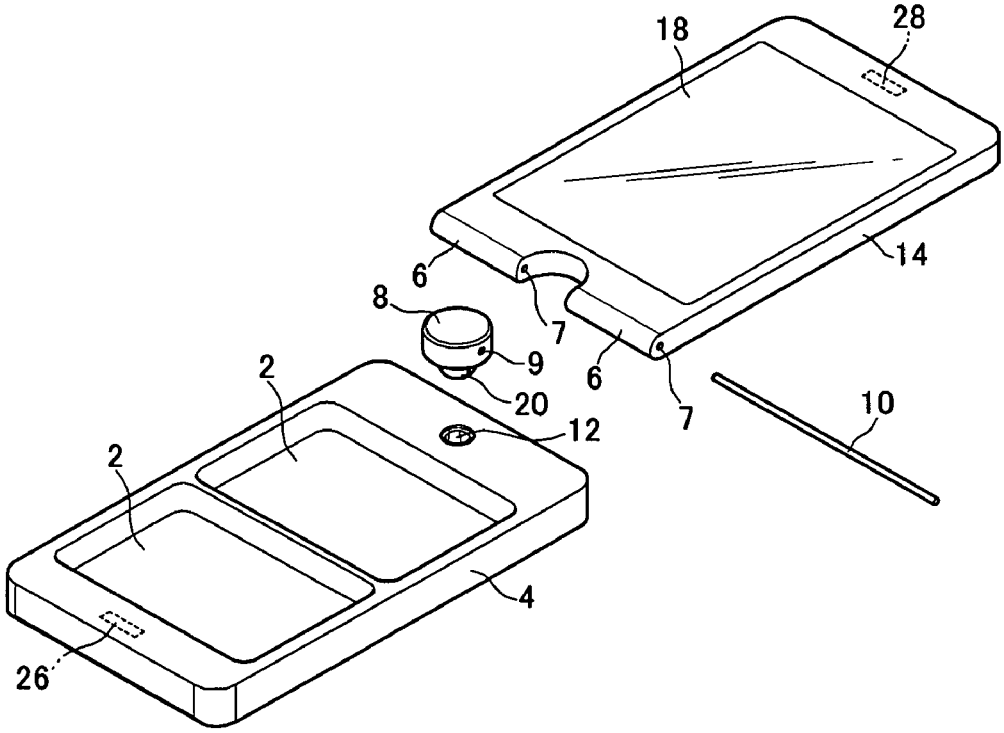
FIG. 5 shows an exploded perspective view of a cosmetic container according to another exemplary embodiment of the present invention.
Figure 6:
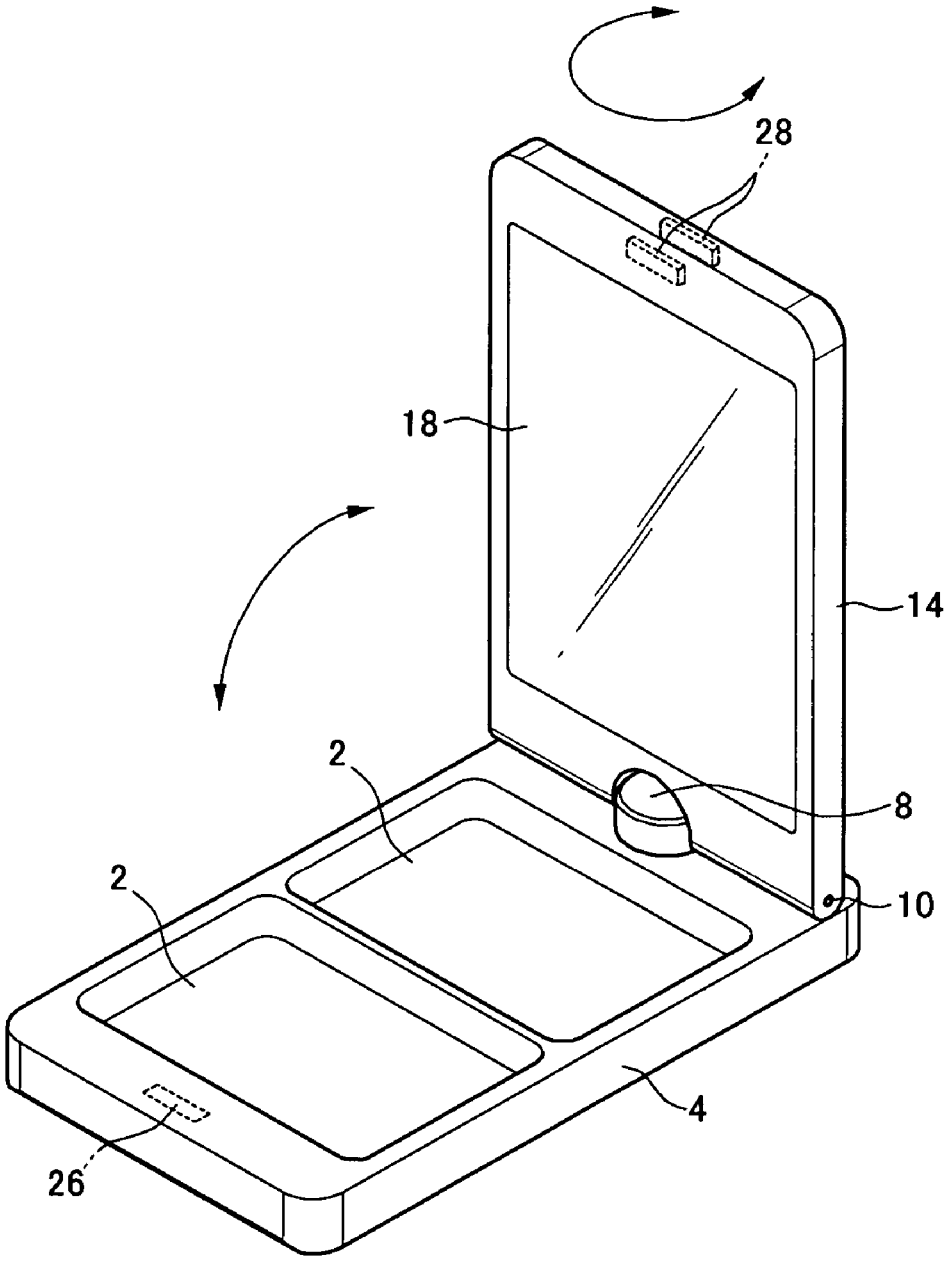
FIG. 6 shows a perspective view representing the assembled cosmetic container.
Figure 7:
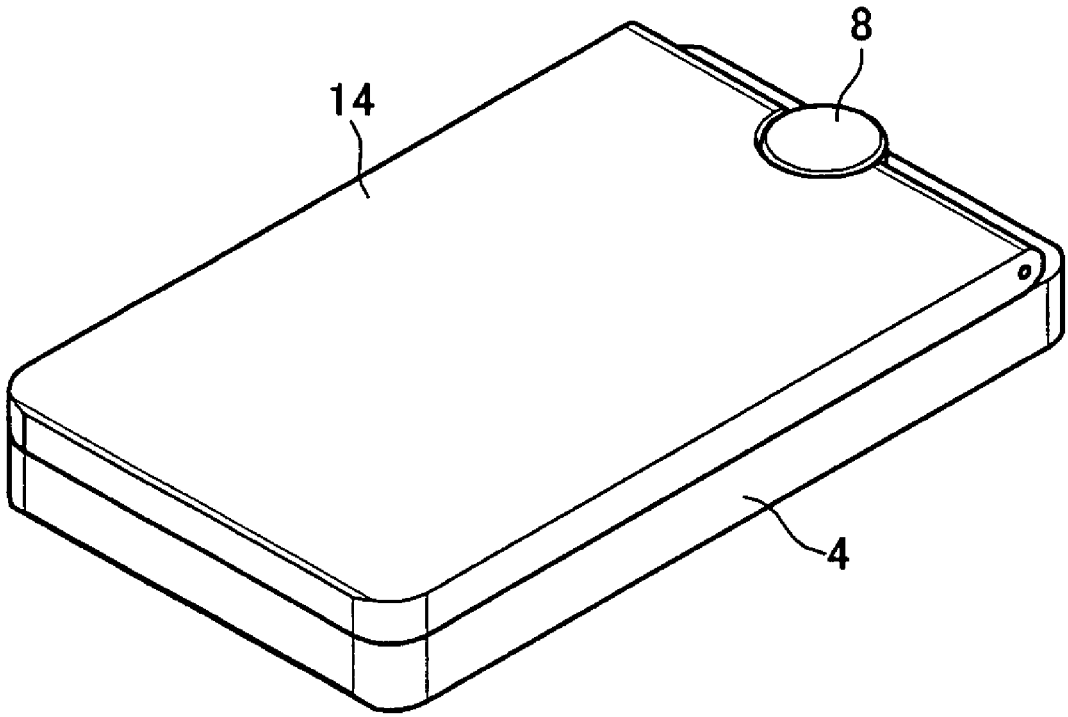
FIG. 7 shows a diagram representing an exterior of the folded cosmetic container.

FIG. 5 to FIG. 7 show diagrams representing a cosmetic container according to a second exemplary embodiment of the present invention.

A basic configuration of the cosmetic container according to the second exemplary embodiment of the present invention includes a body 4 including an inner portion divided into a plurality of inner storage portions 2 and a cover 14 having a mirror 18 on one surface thereof as shown in FIG. 5, which is the same as the cosmetic container according to the first exemplary embodiment of the present invention.

However, there are differences in that hinges 6 are integrally formed at a lower side of the cover 14, a pivot bearing 8 provided as an additional constituent element has a shaft hole 9 on a side thereof and a head 20 divided in two on a bottom thereof, and magnets 26 and 28 are respectively provided to edges respectively corresponding to the latch 22 and the locking groove 24 according to the first exemplary embodiment of the present invention.

While one piece of the magnet 26 is disposed to one spot on the inside of the body 4, it is required to dispose two pieces of the magnet 28 to two spots on the inside and the outside of the cover 14.

In the configuration of the cosmetic container formed as described above, as shown in FIG. 6, the pivot bearing 8 is attached to a pivot hole 12 formed on one side of the body 4 (see FIG. 5), the pivot bearing 8 is assembled between both hinges 6 of the cover 14, a shaft 10 is penetrated through the shaft holes 7 and 9, and therefore, the cover 14 and the body 4 are rotatably connected to each other based on the pivot bearing 8. Therefore, a vertical and horizontal rotation of the cover 14 in relation to the body 4 may be performed.

As described above, a user may look at the mirror 18 at a predetermined angle as shown in FIG. 4, and the body 4 and the cover 14 may be folded as shown in FIG. 7.

It has been inconvenient to use the conventional compact since a cover thereof including a mirror is opened in a predetermined direction. However, according to the exemplary embodiments of the present invention, a user may look at the mirror 18 from a desired angle since the cover 14 is opened in a predetermined direction and is pivot-rotated in a vertical direction to the predetermined opening direction, and therefore, convenience for using the cosmetic container may be increased.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A cosmetic container comprising a planar cover connected to one planar side of a body, said body having an inner portion having at least one inner storage portion, each storage portion being recessed from and open to said one planar side of said body, so that the cover can be opened from the body, the cosmetic container comprising:

the body having a pivot hole formed into said one planar side of the body, said pivot hole having a pivot axis perpendicular to a plane of said one planar side of said body;

a pivot bearing having a portion of said pivot bearing inserted to the pivot hole so that the pivot bearing is rotatable about said axis; and the cover comprising hinges disposed on both sides of the pivot bearing and supported by a shaft penetrating the hinges and the pivot bearing, said shaft lying in a plane parallel to said plane of said one planar side of said body so that the cover is rotatable in an opening/closing direction, wherein said cover is both pivotal around said axis of pivot bearing and also pivotal about the axis of said shaft to move said cover between a closed position in which said cover overlies said one planar side of said body and covers said at least one inner storage portion and an open position in which said cover is moved away from said one planar side of said body thereby uncovering said at least one inner storage portion.

* * * * *